United States Patent [19]

Canon

[11] Patent Number: 4,933,995

[45] Date of Patent: Jun. 19, 1990

[54] FLUSH-OPERATED BATHROOM FAN

[76] Inventor: Carl E. Canon, 3716 36th St., San Diego, Calif. 92104

[21] Appl. No.: 331,946

[22] Filed: Apr. 3, 1989

[51] Int. Cl.[5] ..... E03D 9/04

[52] U.S. Cl. ..... 4/209 R; 4/211; 4/213; 4/306; 4/347

[58] Field of Search ..... 4/213, 661, 209 R, 211, 4/347, 352, 306, 27 E; 98/34.6, 42.07, 1.5, 42.09, 42.04

[56] References Cited

U.S. PATENT DOCUMENTS 3,781,923 1/1974 Moisch et al. ..... 4/213

3,896,509 7/1975 Stipp et al. ..... 4/209

3,939,506 2/1976 Pearson ..... 4/213 X 3,967,545 7/1976 Baker ..... 4/213 X 4,232,406 11/1980 Beeghly et al. ..... 4/213

*Primary Examiner*—Henry K. Artis

*Attorney, Agent, or Firm*—Ralph S. Branscomb

[57] ABSTRACT

A flush-operated bathroom fan is provided which utilizes a float-operated actuator in the water closet tank of the toilet which actuates a switch, turning on the ceiling fan, when the water level in the water closet tank falls indicating that the toilet has been flushed, and when the float rises up again to the normal full-tank water level, the switch is thrown again and the fan is deactivated.

10 Claims, 1 Drawing Sheet

FIG. 1
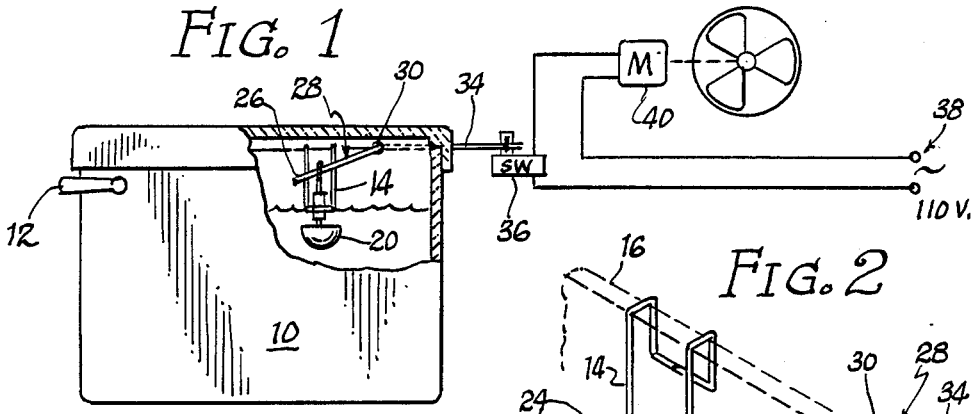
FIG. 2
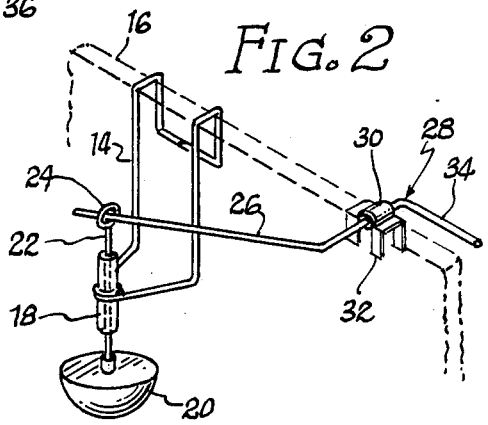
FIG. 3
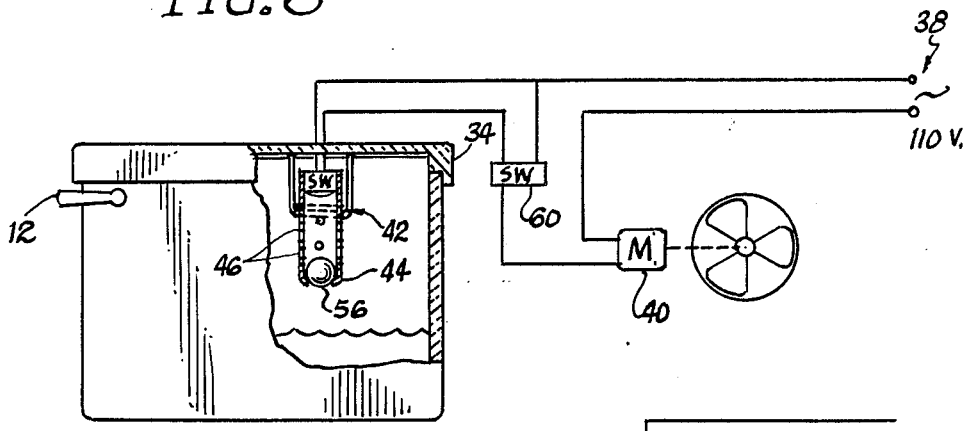
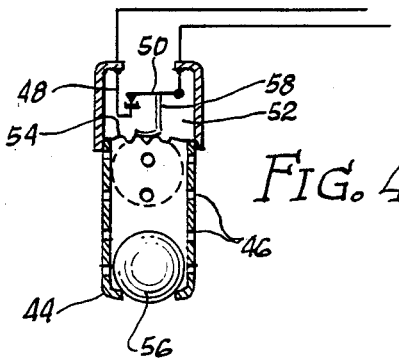
FIG. 4

FLUSH-OPERATED BATHROOM FAN

BACKGROUND OF THE INVENTION

The invention is in the field of bathroom fans of the type generally found in residential construction. These fans are generally mounted in the ceiling of the bathroom, and are provided in bathrooms in almost all new homes, in some states due to code requirements, and in other states because it is state-of-the-art building construction.

Some of these fans are actuated automatically when the light is turned on. Others are controlled by a separate switch. If they go on when the light is turned on, the users are deprived of the option of utilizing them separately, inasmuch as at times it may be desirable to have a light on in the bathroom without the fan going, and vice versa.

The arrangement in which the fan is separately switched suffers from another drawback, namely, the user may forget to turn the fan on when going into the bathroom, or he or she may forget to turn the fan off when leaving the bathroom, which wears the fan bearings out and consumes unnecessary energy.

There is a need, therefore, for a system which actuates the fan every time the toilet is flushed, inasmuch as when the toilet is used, the fan is virtually always needed to evacuate the unpleasant odors and fumes. It is also desirable that the system turn the fan back off again automatically when it is no longer needed.

SUMMARY OF THE INVENTION

The instant invention supplies the above described system, and is operated by connecting the fan to a switch operated by a float in the water closet. The switch is illustrated and described in two embodiments, both of which utilize a float within the water closet tank to sense the water level, with one of them utilizing a pivot rod raised inside the water closet tank by the float, causing an external segment to lower, actuating an external switch which controls the fan.

The second embodiment utilized is a sealed switch inside the water closet tank which is directly actuated by the rising of the float when the water closet tank is filled.

In both embodiments, the position of the float and the switch, or the switch actuating element, is such that the switch is actuated and the fan turned on whenever the water level drops beneath its highest level, so that the fan is on from the time the toilet is flushed, until the time the filling mechanism fills the water closet back to the top again. An optional bypass switch is also included, to give the user maximum flexibility and control over the fan, in the event that the short period of time during which the toilet is flushing is not enough to provide the necessary evacuation, or in case the user prefers to utilize the fan when performing other activities in the bathroom, such as taking a shower, which is particularly advantageous in humid environments.

BRIEF DESCRIPTION OF THE DRAWINGS

FIG. 1 is a front elevation view of a water closet with a portion cut away, showing a float and rod connected to a diagrammatically illustrated switch and fan control system;

FIG. 2 is a perspective view illustrating a wire bracket which holds the float stem, and the actuator rod operated by the float stem;

FIG. 3 is a view identical to FIG. 1 but illustrating a modified type of float and switch inside the water closet; and, FIG. 4 is a diagrammatic, more detailed, view of the float and switch systems of FIG. 3.

DETAILED DESCRIPTION OF THE PREFERRED EMBODIMENTS

A typical water closet is shown at 10, with a flush handle control. The water level varies from the full level indicated in FIG. 1, to the drained, flushed level shown in FIG. 3.

The first embodiment of the invention is best shown in FIG. 2. A wire bracket 14 hooks over the rear edge 16 of the water closet, and suspends a sleeve 18, made of nylon or some other non-corrosive low friction material.

A float 20 is mounted at the bottom of the float stem 22, which defines an eyelet 24 above the sleeve. As the float drops with the water level, the eyelet on the float stem draws down the inner end 26 of the actuator rod 28.

The actuator rod is pivotally mounted in a second sleeve 30, or is otherwise retained freedom in the area of the rear edge 16 of the water closet tank. The second sleeve 30 is held down by a clip 32 which engages the top edge 16 of the water closet tank. Some water closets tank have a pair of cutaways in the upper edge of the rear wall, which would provide convnient pass-through mounting spots for the sleeve 30 and still permit the water closet lid 34 to fit over the water closet tank. Otherwise, the lid might have to be notched, or the sleeve put through a hole bored in the upper rim of the water closet tank.

In any event, as the inner end 26 of the actuator rod swings up and down responsive to the float action, the outer portion 34 of the actuator rod actuates and deactuates the switch 36. As shown in FIGS. 1 and 3, switch 36 is interposed between house current source 38 and the fan motor 40.

A modification is shown in FIGS. 3 and 4 in which the fan motor control switch 40 is mounted inside the water closet tank, again with a bracket 42 similar to bracket 14, but adapted to hold upright cylinder 44 instead of a sleeve. The cylinder 44 is perforated at 46 in its lower reaches, and the top portion mounts a fixed contact 48 and a moveable contact 50. The contacts are enclosed in a sealed inner chamber 52, the bottom of which is defined by a flexible diaphragm 54. A ball float 56 is captured in the cylinder, and as it moves up, riding on the rising water in the water closet tank, it pushes the diaphragm against the depending arm 58, rigidly mounted to moveable arm 50, and separates the moveable contact from the fixed contact 48. Thus, the rising ball opens the switch and turns off the fan, and as the float ball falls, the fan is turned on.

The embodiment of FIGS. 3 and 4 is somewhat diagrammatic, and illustrates in a general fashion a means of implementing a switch system in which the switch is contained within the tank, and directly actuated by a ball float without risking shorting out the contacts of the switch with water.

FIG. 3 also illustrates that bypass switch 60 which effectively cuts the float switch system out of the circuit. This bypass switch could equally easily be mounted on the embodiment of FIGS. 1 and 2. As mentioned above, the bypass switch enables the user to turn on the fan when the toilet is not being flushed, such as when taking a shower. It should be noted that as long as the toilet is flushing, the fan will be turned on irrespective of whether or not the switch 60 is open or closed, so the switch 60 cannot override the flush system actuator, but is simply used to turn the fan on when the toilet is not being flushed.

In either embodiment, the invention is advantageous over a standard wall switch, either of the automatic type coupled with the bathroom light or the independent kind, in that it ensures that the ceiling fan is on right after the toilet has been used. Further advantages include the elimination of unnecessary wear on the fan motor, the fan, and the bearings, and it eliminates completely energy consumption that occurs when someone forgets to turn the fan off when leaving the bathroom.

I claim:

1. A bathroom fan actuating system operative to turn on a bathroom fan separate and remote from a toilet upon flushing said toilet with a water closet tank in the bathroom, said fan actuating system comprising:

(a) a water level sensor mounted in said toilet water closet;

(b) said sensor having means to sense the level of water in said water closet tank;

(c) a switch operatively connected to said sensor such that upon the dropping of the water level in said water closet tank from the full level indicative of the toilet having been flushed, the switch is turned on, and upon the subsequent rising of the water level in said water closet to the full level, said switch is turned off again;

(d) said switch being wired to said fan to control the same, such that said fan is turned on in response to said toilet being flushed, and turned off again when said water closet tank refills to the normal full-tank water level.

2. Structure according to claim 1 wherein said sensor includes a float to physically actuate said switch between on and off positions as said float falls and rises, respectively.

3. Structure according to claim 2 wherein said float is mounted to the bottom of a vertical stem, and said stem is linked to an actuator rod which is operative with said switch, such that the rising of said float causes said shaft to move said rod to turn said switch off, and vice versa.

4. Structure according to claim 3 said switch is external of said water closet tank, and said actuator rod extends from inside said water closet tank where it is linked to said stem, to outside said water closet tank operative with said switch.

5. Structure according to claim 4 wherein said water closet tank has an upper edge, and said actuator rod is pivotally mounted to said upper edge.

6. Structure according to claim 5 and including a mounting bracket engaged over said edge, said mounting bracket mounting a sleeve spaced from said edge through which said vertical stem slides.

7. Structure according to claim 1 and including a manually operated second switch bypassing the first-mentioned switch to enable the user to turn said fan on at will.

8. Structure according to claim 6 wherein said switch is mounted inside said water closet tank, and said sensor is a float which rides on water in said water closet tank and directly acts against said switch.

9. Structure according to claim 8 wherein said switch has a fixed contact and a vertically moveable contact, and said float is mounted to permit vertical motion to raise and lower said moveable contact out of and into contact with said fixed contact, respectively.

10. Structure according to claim 9 wherein said contacts are sealed with an underlying flexible diaphragm found and said float presses against said diaphragm when it rises to move said moveable contact away from said fixed contact.

* * * * *